US006918366B2

(12) United States Patent
Schmidt et al.

(10) Patent No.: US 6,918,366 B2
(45) Date of Patent: Jul. 19, 2005

(54) DEVICE FOR IGNITING AN AIR-FUEL MIXTURE IN AN INTERNAL COMBUSTION ENGINE

(75) Inventors: Ewald Schmidt, Ludwigsburg (DE); Hans-Oliver Ruoss, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 111 days.

(21) Appl. No.: 10/650,938

(22) Filed: Aug. 27, 2003

(65) Prior Publication Data

US 2004/0123851 A1 Jul. 1, 2004

(30) Foreign Application Priority Data

Aug. 28, 2002 (DE) ..... 102 39 409

(51) Int. Cl.[7] ..... F02P 23/00
(52) U.S. Cl. ..... 123/143 B; 313/231.31
(58) Field of Search ..... 123/143 B; 313/143, 313/231.31

(56) References Cited

U.S. PATENT DOCUMENTS 6,357,426 B1 * 3/2002 Schleupen ..... 123/606
6,581,581 B1 * 6/2003 Bebich ..... 123/536

FOREIGN PATENT DOCUMENTS

DE 198 52 652 5/2000
DE 10243271 A * 12/2003
EP WO2004020820 * 3/2004
JP 57-186067 5/1981
JP 3-31579 6/1989

OTHER PUBLICATIONS

SAE Paper 970071, Investigation of a Radio Frequency Plasma Ignitor for Possible Internal Combustion Engine Use.

* cited by examiner

*Primary Examiner*—John T. Kwon
(74) *Attorney, Agent, or Firm*—Kenyon & kenyon

(57) ABSTRACT

A device for the ignition of an air-fuel mixture in an internal combustion engine using a high-frequency electrical energy source. A coaxial waveguide structure forming a resonator chamber, into which the high-frequency electrical energy is able to be fed in a predefined coupling-in location at one end of an inner conductor of the waveguide structure. The coupling-in location is designed so that the inner conductor in the region of the coupling-in location is laterally opened out fanwise, and, in this context, a predefined length is continued coaxially between the outer wall and the coaxial waveguide structure and a feed line. Consequently, a feed line may be coupled on coaxially, using which the supply of the electrical energy takes place through a coaxial insulation in the outer wall of the waveguide structure into the resonator chamber.

4 Claims, 1 Drawing Sheet

DEVICE FOR IGNITING AN AIR-FUEL MIXTURE IN AN INTERNAL COMBUSTION ENGINE

FIELD OF THE INVENTION

The present invention relates to a device for igniting an air-fuel mixture in an internal combustion engine using a high-frequency energy source.

BACKGROUND INFORMATION

The ignition of such an air-fuel mixture using a so-called spark plug represents a usual component of internal combustion engines for motor vehicles. In these ignition systems installed these days, the spark plug is supplied inductively, using an ignition coil, with a sufficiently high electric voltage so that an ignition spark at the end of the spark plug forms in the combustion chamber of the internal combustion engine in order to start the combustion of the air-fuel mixture.

During the operation of this customary spark plug, voltages up to more than thirty kilovolt may appear, residues such as soot, oil or coal as well as ashes from fuel and oil appearing, which, under certain thermal conditions are electrically conductive. However, at these high voltages, no sparkover or breakdowns may occur at the insulator of the spark plug, so that the electrical resistance of the insulator should not change even at the high temperatures that appear during the service life of the spark plug.

From German Patent No. DE 198 52 652, for example, a spark device is known in which the ignition of such an air-fuel mixture is undertaken in an internal combustion engine of a motor vehicle, using a coaxial line resonator. In this connection the ignition coil is replaced by a sufficiently powerful microwave source, for instance, a combination of a high frequency generator and an amplifier. In the case of a geometrically optimized coaxial line resonator, the field strength required for ignition then comes about at the open end of the plug-like line resonator, and an ignitable plasma path forms between the electrodes of the plug.

The electrical excitation of this known coaxial line resonator takes place by a lateral coupling, these feeding devices, to be sure, taking up an undefined angular position after the screwing in of the so-called HF plug. In order to convert the contact position to a better manageable axial position, possibly by appropriately constructive measures, a relatively large radial or even axial space requirement consequently becomes necessary even when screwing it in.

Such a high frequency ignition is also described in general in the paper "SAE Paper 970071, Investigation of a Radio Frequency Plasma Ignitor for Possible Internal Combustion Engine Use". In the case of this high frequency ignition or microwave ignition, without the usual ignition coil but using low-ohm feeding, a high voltage is generated at the so-called hot end of a $\lambda/4$ line of an HF line resonator.

SUMMARY OF THE INVENTION

The present invention starts from a device for igniting an air-fuel mixture in an internal combustion engine, using a high frequency electrical energy source, having a coaxial waveguide structure forming a resonator chamber, into which the high frequency electrical energy is able to be fed at a predefined coupling-in location at one end of the internal conductor of the coaxial waveguide structure. The other end of the internal conductor projects into the respective combustion chamber of a cylinder of the internal combustion engine, at this end a free-standing plasma cloud being able to be generated by a superelevation of the electrical field strength.

In this context, the coaxial waveguide structure is developed in a method known per se in such a way that, for a predefined effective wavelength $\lambda_{eff}$ of the coupled-in high frequency oscillation, a line resonator comes about approximately according to the relationship $(2n+1)*\lambda_{eff}/4$, where $n \geqq 0$, and the high-frequency oscillation is coupled in, for example, by a capacitive, inductive, mixed or aperture coupling. The effective wavelength $\lambda_{eff}$ is, in this context, determined essentially by the shaping of the end of the projecting inner conductor by the sealing of the dielectric material or by the shaping of the entire line resonator.

In the specific embodiments according to the present invention the electrical field strength required for the ignition in the combustion chamber consequently sets in at the open end of the resonator, which in its shape is to a great extent similar to a spark plug. The main advantages of such a high frequency spark plug over the usual use of a spark plug are above all cost savings, space savings and savings in weight, because of the possibility of miniaturization. The independence from the heat value (coefficient of heat transfer), achieved to a great extent by the device, additionally makes possible a reduction of the multiplicity of models, and thus also cost savings.

Because here, in a simple manner, an electrical measuring or control signal is able to be extracted, preferably in the oscillator, but possibly also in other areas of the coaxial waveguide, which is a function of the physical values of the free-standing plasma in the air-fuel mixture, in principle, that makes it possible to adjust the flame size, whereby one may achieve an enlarged ignition volume compared to that of the usual spark plug, and a good introduction of the flame front into the combustion chamber. This leads to an increase in ignition reliability, particularly in lean mixture engines and in the case of direct fuel injection.

Furthermore, because of the controllability of the duration of combustion based on the possibility of derivating extractable control signals, additional degrees of freedom are available. The derivated electrical signal is processed further in an evaluating circuit, which is able to effect, for example, a diagnosis of the system, a regulation of the high-frequency energy source and/or control of specified operating functions. This controllability based on the possibility of combustion diagnostics, and thus the optimization of engine control, leads to a lesser wear of the structures acting as ignition electrodes, and, in addition, it makes possible a controlled burning off of contamination, such as soot.

Advantageously, according to the present invention, the coupling location for the electrical energy is formed in such a way that a feed line is positioned coaxially, by the use of which the supply of the electrical energy takes place through a coaxial insulation in the outer wall of the waveguide structure in the resonator space. In the device according to the present invention, as compared to the coupling mechanisms known from the related art, the inductive or galvanic coupling is replaced using a known lateral supply by an advantageously axially positionable design that is on the reverse side and possibly also of low ohmage. The present invention has some features which advantageously improve the up-to-the-present feeding in such a way that the feeding is able to be carried out via a few additional simple elements in the resonator chamber.

The otherwise continuous inner conductor in the resonator chamber, according to a first specific embodiment of the present invention, is spread out fanwise in the feed region and is positioned between the feed line and the oscillator wall. Thus, the inner conductor is continued laterally by a specified length, coaxially between the outer wall of the coaxial waveguide structure and the feed line which is formed in axial continuation of the inner conductor. At the end, this fanwise spreading is contacted to the outer wall of the coaxial waveguide structure.

In this context, the fanned-out region of the inner conductor may be formed in a simple manner by at least one contact foot on the inner conductor and continuing through at least one contact plate connected to the outer wall of the waveguide structure, the at least one contact foot and the at least one contact plate being able to be connected on the inner conductor and at the outer wall by welding, shrinking or soldering. Preferably, three radially uniformly distributed contact feet and contact plates may be positioned here. However, these parts may also be produced as one piece by suitable methods, e.g. as a die-cast part.

In summary, using the specific embodiments according to the present invention, there comes about a good, reproducible possibility of impedance adjustment at the coupling location by a suitable selection of the geometrical dimensionings. These structures are directly suitable for connecting a coaxial plug for the supply of electrical energy, the selection of the outer conductor's diameter of the feeding line being possible within wide limits. The concept is also suitable in a simple manner for integration into existing resonator structures.

DETAILED DESCRIPTION

Figure 1:
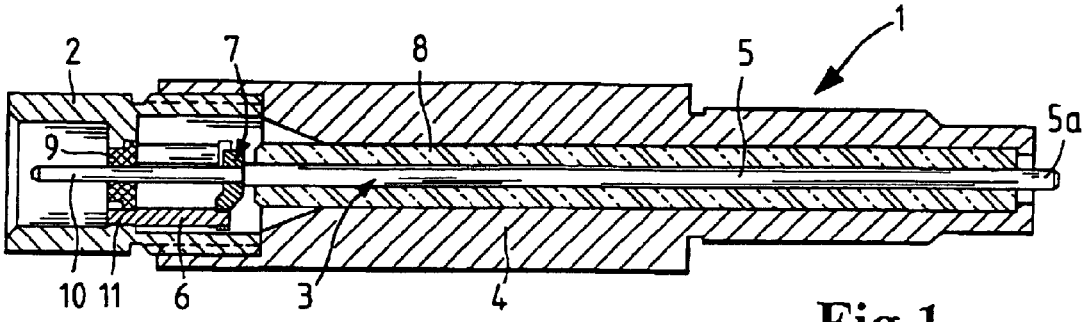
FIG. 1 shows a section through a device for high-frequency ignition of an air fuel mixture in an internal combustion engine having a coaxial waveguide structure as resonator and a coaxial coupling of the high-frequency electrical energy at a fanned-out inner conductor.

FIG. 1 shows a view of the principle of a device for the high-frequency ignition of an air-fuel mixture in an internal combustion engine, which has components of a so-called high frequency spark plug 1. Going into details, an HF generator not shown here and an amplifier, that may possibly be gotten by without, are present, which, as the microwave source, generate the high frequency oscillations. A coupling-in, explained in greater detail below, of the high frequency oscillations into a coaxial waveguide structure designed as a $\lambda_{eff}/4$ resonator 3 is carried out via a coaxial plug system 2, as an important component of high frequency spark plug 1.

Coaxial resonator 3 is made up of an outer conductor 4, i.e. the outer wall of the waveguide structure and an inner conductor 5, the one so-called open or hot end of resonator 3 effecting the ignition using inner conductor 5 as ignition pin 5*a*. For the high-frequency oscillations, the other so-called cold end 6 of resonator 3, that is at a distance from the combustion chamber, at which there is also coupling-in location 7, represents a short circuit. The dielectric 8 between outer conductor 4 and inner conductor 5 is made here of ceramic or of a suitable non-conducting material, and in the region of coupling-in location 7 is made of air.

Consequently, in this high-frequency spark plug 1, the principle is used of the superelevation of the field in a coaxial resonator 3 having a length $(2n+1)*\lambda_{eff}/4$, where $n \geqq 0$. The high-frequency signal generated by a sufficiently strong microwave source as generator is fed in at coupling-in location 7 into resonator 3. Due to the formation of a potential node at short circuit 6 (cold end) and a voltage antinode at the one open end (ignition pin 5*a*) a field superelevation comes about here by which the ignition can be effected.

Figure 2:
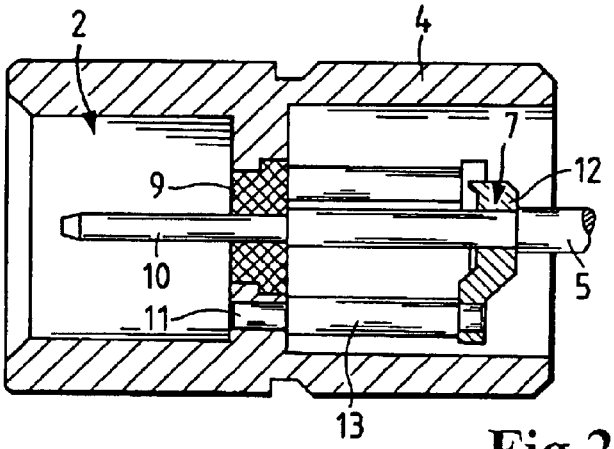
FIGS. 2 and 3 show views of the coupling-in location according to FIG. 1, in detail.
Figure 3:
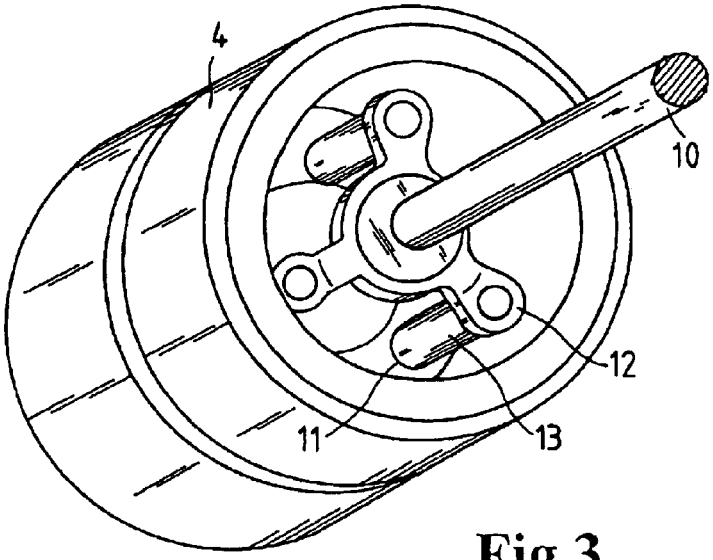

Coupling-in location 7 for the electric energy is designed, according to FIG. 1 and the detailed representations in FIGS. 2 and 3 in such a way that a line may be affixed at coaxial plug contact 2, by which the supply of electrical energy through a coaxial insulation 9 takes place via a feed line 10 to coupling-in location 7, and thus into the resonator chamber of waveguide structure 3.

Inner conductor 5 is here laterally opened out fanwise in the resonator region of coupling-in location 7, and positioned at a predefined length between feed line 10, which is formed in axial continuation of inner conductor 5, and the oscillator wall or outer conductor 4. At end 11, this fanwise spreading is contacted to outer wall 4 of coaxial waveguide structure 3.

In this context, the region of inner conductor 5 that is opened fanwise may be formed, as may be seen in FIGS. 2 and 3, in a simple manner by contact feet 12 on inner conductor 5, and, continuing on, by a contact plate 13 connected to outer wall 4 of waveguide structure 3, contact feet 12 and contact plates 13 being able to be contacted to inner conductor 5 and to outer wall 4 by welding, shrinking or soldering.

What is claimed is:

1. A device for an ignition of an air-fuel mixture in an internal combustion engine using a high-frequency electrical energy source, comprising:

a coaxial waveguide structure forming a resonator chamber, into which a high-frequency electrical energy is able to be fed at a predefined coupling-in location at one end of an inner conductor of the waveguide structure, wherein the waveguide structure extends with the other end of the inner conductor into a respective combustion chamber of a cylinder of the internal combustion engine, a microwave plasma being able to be generated at the other end by a high-voltage potential, and wherein the coupling-in location is formed in such a way that a feed line is able to be coupled on coaxially, using which a supply of the electrical energy takes place through a coaxial insulation in an outer wall of the waveguide structure into the resonator chamber.

2. The device according to claim 1, wherein the inner conductor is laterally fanned out in a region of the coupling-in location, and, in this context, a predefined length is continued coaxially between the outer wall of the waveguide structure and the feed line and is contacted, ending at the outer wall of the waveguide structure, and wherein the feed line is designed as an axial continuation of the inner conductor.

3. The device according to claim 2, wherein a fanwise opened region of the inner conductor is formed by at least one contact plate connected to the outer wall of the waveguide structure.

4. The device according to claim 3, wherein at least one contact foot and the at least one contact plate are contacted at the inner conductor and at the outer wall by one of welding, shrinking, and soldering.

* * * * *